United States Patent [19]

Hohorst

[11] 4,258,487

[45] Mar. 31, 1981

[54] MARKER PLATE STRIP FOR MARKING MULTIPLE TERMINALS

[75] Inventor: Wolfgang Hohorst, Minden, Fed. Rep. of Germany

[73] Assignee: Wago-Kontakttechnik GmbH, Minden, Fed. Rep. of Germany

[21] Appl. No.: 53,187

[22] Filed: Jun. 29, 1979

[30] Foreign Application Priority Data

Jul. 6, 1978 [DE] Fed. Rep. of Germany ..... 2829620

[51] Int. Cl.[3] ..... A44C 3/00

[52] U.S. Cl. ..... 40/2 R; 40/312; 339/113 R

[58] Field of Search ..... 40/2 R, 301, 302, 312, 40/316, 331, 16, 16.2, 21 C; 428/52; 339/198 GA, 113 R, 113 L, 113 B

[56] References Cited

U.S. PATENT DOCUMENTS

| | | | |
|---|---|---|---|
| 1,563,371 | 12/1925 | Jones | 40/2 R |
| 2,990,196 | 6/1961 | Slavsky | 40/16.2 X |
| 3,205,406 | 9/1965 | Pick et al. | 339/198 GA |
| 3,259,876 | 7/1966 | Norden | 339/198 |
| 3,556,291 | 1/1971 | Sebring | 40/21 C X |
| 3,708,899 | 1/1973 | Berry, Jr. | 40/16 X |
| 3,838,777 | 10/1974 | Thornicroft et al. | 339/113 B |
| 4,032,010 | 6/1977 | Evans | 40/316 X |

FOREIGN PATENT DOCUMENTS

| | | | |
|---|---|---|---|
| 2428756 | 11/1975 | Fed. Rep. of Germany | 339/198 GA |
| 891095 | 3/1962 | United Kingdom | 339/113 B |

OTHER PUBLICATIONS

Klippon Catalog, pp. 5 and 6.
Buchanan Catalog, pp. 5 and 173.
Wago Catalog, 4 pages.

*Primary Examiner*—John F. Pitrelli
*Assistant Examiner*—G. Lee Skillington
*Attorney, Agent, or Firm*—Salter & Michaelson

[57] ABSTRACT

A marker plate construction for use in terminals, particularly, serially disposed multiple terminals as used in switching appliances. Known marker plates are linked into strips and have to be individually separated from the strip in cases when the juxtaposed terminal blocks have different widths. The marker plate strips according to the invention include tear-off connectors between the individual marker plates which are extensible, or are of variable length in such a manner that the cutting of the marker plate strip during the insertion of the individual marker plates at separate terminal blocks is eliminated.

9 Claims, 8 Drawing Figures

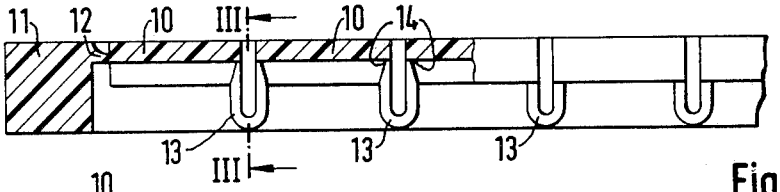
Fig. 2
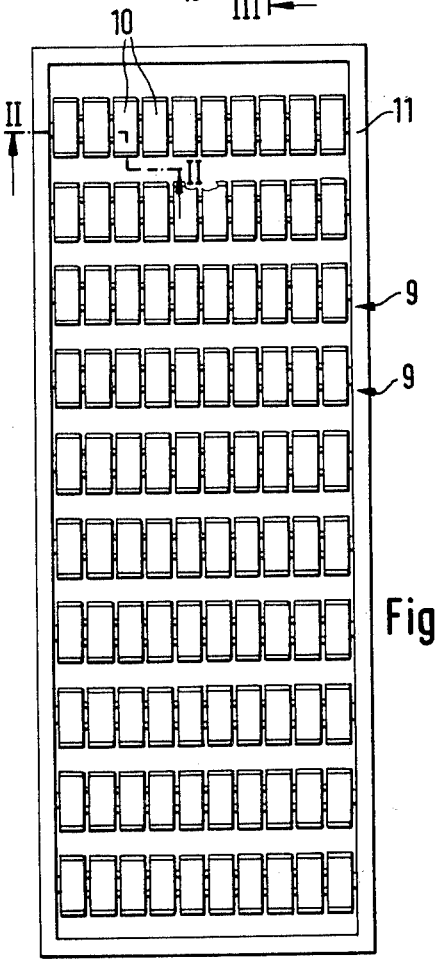
Fig. 1
Fig. 3
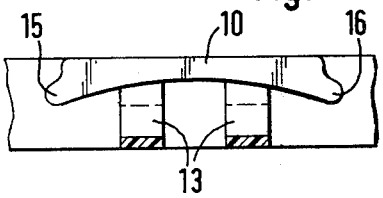
Fig. 4
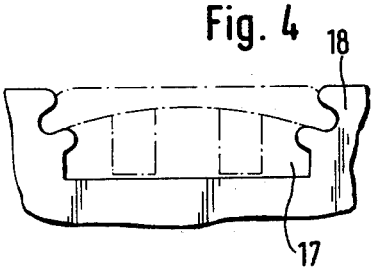
Fig. 6
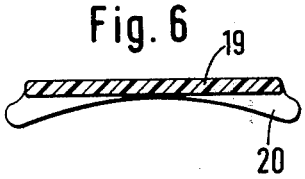
Fig. 5
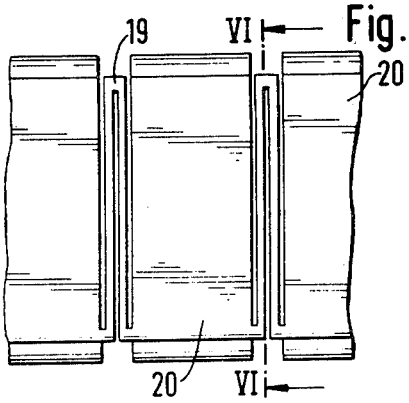
Fig. 7
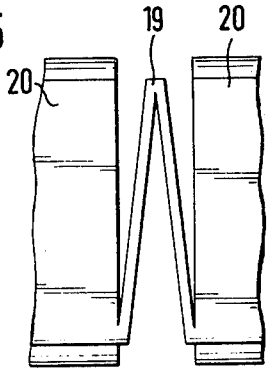
Fig. 8
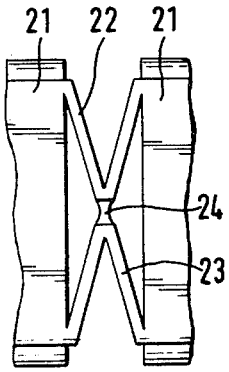

MARKER PLATE STRIP FOR MARKING MULTIPLE TERMINALS

BACKGROUND AND SUMMARY OF THE INVENTION

The invention concerns a marker plate strip construction comprising individual marker plates interconnected mutually by means of tear-off connectors and serving for the marking of the electric terminals arranged one after another in a row. The individual marker plates are mountable in depressions, i.e. grooves, formed in the terminal housing.

The marking of the electric terminals, and particularly of those arranged on a carrier rail electric terminal normally requires considerable time and labor consuming effort. In order to reduce the labor consumption, there are used in practice the so-called marker plate strips, consisting each of large numbers of individual marker plates, mutually interconnected by means of tear-off connectors, which marker plates receive handwritten or pre-printed marking symbols. These marker plate strips are manufactured either as individual strips, or as assemblies of strips arranged as parallel to each other and assembled by means of a peripheral frame into a card from which the individual strips or even individual marker plates can be cut out one after another.

The individual marker plates for the marking of the separate terminals are inserted in corresponding depressions made in the terminal housing. As a rule, the breaking, cutting or tearing of the tear-off connectors takes place only after insertion of a marker plate in such depression in the terminal housing, avoiding thus the tiresome manipulation of the individual, relatively small marker plates.

The advantage of the manipulation of marker plates in form of strips is particularly important in the case of the marking of a row of multiple terminals arranged one after another, because of a noticeable simplification of the work. In such multiple (serial) terminal arrangements, the depressions for the reception of the individual marker plates are usually in the shape of a groove open on both sides thereof, in such a manner that a marker plate strip marker can be easily inserted with its upper or lower edge in the groove-like depression, and the cutting of the tear-off connectors may be carried out in a simple manner after the insertion of the marker plates.

In those cases where the serially arranged terminals are of the same type and width, the cutting of the marker plate strips in the individual marker plates is not necessary because of the mutually aligned grooved depressions, provided that the plate strip comprises the necessary continuous marking symbols for the serially arranged multiple terminals. The marker plate strip is therefore placed as a whole, which permits to achieve a noticeable time and labor saving, since the insertion of the individual marker plates or of the marker plate strip in the depressions provided in the housing does not require any complicated work procedures.

The object of this invention is to reduce still more the time and labor consumption by using the above described marker plate strips for the marking of the individual terminals placed one after another in a row.

Such object is attained according to the invention by providing that the length of the tear-off connectors between the individual marker plates can be varied, i.e. extended by means of the application of a tensile force in the longitudinal direction of the marker plate strip. According to one particularly advantageous form of the invention it is foreseen that the widths of the individual marker plates, as measured in the longitudinal direction of the marker plate strip correspond to the width of the depressions for the narrowest terminal block, and that the tear-off connectors are extensible, thus permitting the variation of distances of the marker plates one from another.

It has already been said that the insertion of a continuous marker plate strip was until now possible only if all the serially placed terminals are characterized by an equal terminal block width. This terminal block width is, however, a decisive factor in deciding how many terminals can be constructively placed on an existing carrier rail in an available space. Therefore, in the practice, notwithstanding the use of terminals of the same type, the terminal block width is dimensioned as narrow as possible and adapted to the section of the used leads. The current terminal block widths are for instance, 5, 6, 8 and 12 mm.

In practice, the widths of the serially disposed multiple terminals varies relatively often. This means that with the known marker plate strips there has to be carried out strip cuttings, even if the strip has been preprinted with the necessary continuous symbols. Here one finds the most significant advantage of the invention. A marker plate strip carried out according to the invention can be extended and lengthened, so that to each separate terminal there can be assigned a marker plate without cutting the tear-off connectors between the separate marker plates. The herein achieved time and labor savings are particularly significant in mass manufacturing, since the repeated combinations of multiple terminals can be rapidly and easily marked by means of the corresponding pre-printed marker plate strips.

Manufacturing expenses, and particularly inventory and storage expenses for the marker plate strips are decidedly lowered by using the marker plate strips according to the invention, both as individual strips, or in the condensed, card-like shape.

Previously, marker plates of various different widths have been stored for use. Now there can be used a standard-sized marker plate, adaptable to all and any terminal execution forms. This standard marker plate is dimensioned to correspond to the depression width or the terminal block width of the narrowest terminal block construction. This marker plate may then also be used for wider terminal block constructions. With the frequent variations in the terminal block widths in the multiple terminal rows, the marker plate strip does not need to be cut anymore, since it may be adapted to the lengths of the tear-off connectors to the actual spacing of the terminals by applying a slight tensile force in the longitudinal direction of the marker plate strip. In a suitable form of the invention it is foreseen that the length variations of the tear-off connectors can be achieved by the arrangement of one or more constructive extension pleats in the tear-off connector. These extension pleats can be for instance situated in the marker plate plane, in such a manner that they do not protrude beyond the main section profile of the marker plate strip and are not cumbersome.

If there are necessary and particularly important length variations, some protruding of the extension pleats beyond the main section profile can be tolerated and allowed for by, for instance, making the recesses for the insertion of the marker plates deeper so as to accommodate the extension pleats of the tear-off connectors. These constructive extension pleats can be totally avoided, if according to another form of the invention the tear-off connectors are formed of an elastically or plastically extensible material. In practice it can also prove advantageous to use for example, a plastically extensible material for the tear-off connector as combined with the constructive extension pleats within the tear-off connector. In case of a length variation there will be first used the length variation allowed for by the constructive extension pleat, and a further, complementary length variation will be obtained by a subsequent extension of the tear-off connector material.

Also, tear-off connectors whose length variation takes place by a sort of a gliding connection between two relatively movable connector parts may be provided. The manufacturing of such tear-off connectors would be substantially more expensive than the manufacturing of the previously above described execution forms.

Other objects, features and advantages of the invention shall become apparent as the description thereof proceeds when considered in connection with the accompanying illustrative drawing.

DESCRIPTION OF THE INVENTION

Following there will be described in more detail the various forms of the invention as based on drawings which represent:

FIG. 1 is a plan view showing a plurality of marker plate strips according to the invention, condensed by the peripheral frame into a card-like shape.

FIGS. 2–4 are sectional views showing one form of a marker plate strip according to the invention.

FIGS. 5–7 are views showing a second form of the invention.

FIG. 8 is a view showing a third form of the invention.

FIG. 1 shows strips 9 of marker plates 10, contained by a peripheral frame 11 into a card-like form. The peripheral frame holds the marker plate strips together during the manufacturing and particularly during the printing of the individual marker plates 10. Subsequently for example, the upper and lower crosspieces of the frame, or, additionally, one of the longitudinal crosspieces can be cut off in order to simplify the manipulation and finishing of the individual marker plate strips 10.

FIG. 2 shows a horizontal section through an individual marker plate strip along the line II—II of FIG. 1. It can be seen that the strips 9 are connected to the longitudinal crosspiece of the frame at each side thereof by a breakable connector 12.

Adjacent marker plates 10 are connected together by means of two tear-off connectors 13 whose shape can be seen in more detail in FIGS. 2 and 3. The tear-off connectors include predetermined breakable spots 14, located quite close to the edge of the marker plate 10 in such a manner that the connector can be cleanly torn away from the marker plate without any protruding appendage.

In FIG. 3, the special shape of the shown marker plate 10 can best be seen. FIG. 4 shows how the marker plate 10 with both its side edges 15 and 16 is inserted in a correspondingly adapted groove-like cavity 17 of the terminal housing 18. The plates 10 are generally of planar configuration and include opposite surfaces, that is, an upper or outer surface adapted for the receipt of marking indicia as previously explained and a lower or inner surface from which the tear-off connectors 13 serve to connect adjacent plates 10 to each other. The protruding below tear-off conconnectors 13 are disposed in the groove-like cavity 17 in such a manner that the marker plate 10 connects closely with the visible surface of the terminal housing.

As hereinafter more fully described, the length of the marker plate strips may be varied because of the pleat construction of the tear-off connector. A supplementary extension can be achieved by an elastic or plastic deformation of the tear-off connector 13 material, which can consist for example of a polyamide plastic resin.

FIGS. 5, 6 and 7 show a tear-off connector 13 provided in the marker plate 10 plane with an extension pleat. FIG. 5 shows the cutting-out from a marker plate strip with closely located marker plates 20. In the FIG. 7 there is shown a similar marker plate strip with more spaced marker plates 20 and a correspondingly open extension pleat of the tear-off connector 19.

FIG. 6 shows that the tear-off connector 19 is always located in the marker plate 20 plane and that the plate shape corresponds to the shape of the marker plate 10 according to the FIGS. 2 and 3.

In this form of the marker plate strip according to the invention, there can be provided in the terminal housing very flat (shallow) depressions for receiving the marker plates or the marker plate strip.

FIG. 8 shows, as compared with the FIG. 7 an example of the invention in which between the two adjacent marker plates 21 there are provided two tear-off connectors, both of which are located in the marker plate 20 plane. Both of these tear-off connectors 22 and 23 impart to the marker plate strip a better stability as compared with the example according to FIG. 7.

If it is desired to achieve a length variation in the marker plate strip according to the FIG. 8 beyond a certain measure, only against a certain blocking force to overcome, the tear-off connectors 22 and 23 can be bound together at the top of their extension pleats by means of a traverse 24 which in case of a certain desired larger length variation has to be elastically or plastically deformed, and, if necessary, torn.

All of the above described execution examples of the invention have the advantage that they can be manufactured in a single operation as by known molding techniques and are ready for use without secondary forming operations.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A longitudinally oriented marker plate strip including a plurality of side by side disposed individual plates for the marking of individual electrical terminals also disposed together in side-by-side relation and wherein each of said terminals includes a housing in turn having a groove for receiving one of said plates, each of said plates of a relatively planar configuration and having an outer surface adapted for the receipt of marking indicia, said plates having opposed side walls with the side walls of adjacent plates generally equally spaced from each other, adjacent plates being connected to each other by at least one tear-off connecting member which forms a mechanically extensible link such that tensile force applied to adjacent plates in opposite longitudinal directions varies the separation between said adjacent marker plates.

2. The marker plate strip construction according to claim 1, wherein the width of the individual marker plates measured in the longitudinal direction of the marker plate strip corresponds to the width of the groove of the narrowest terminal block.

3. The marker plate strip construction according to claim 1, wherein the length variation of the tear-off connecting members is attained by means of the interposition of at least one extensible pleat in the tear-off connecting member.

4. The marker plate strip according to claim 3 wherein said tear-off connecting member is located in the same plane as said adjacent plates.

5. The marker plate strip according to claim 4 wherein the connecting member is a V-shaped pleat having its spaced terminal legs integrally connected to the respective opposed side walls of said adjacent plates.

6. The marker plate strip according to claim 4 wherein the connecting member is an X-shaped pleat having its legs integrally connected to the respective opposed sidewalls of said adjacent plates.

7. The marker plate strip according to claim 3 wherein adjacent plates are interconnected by a pair of U-shaped pleats generally normally extending from the inner surface of said plates and laterally spaced apart from each other.

8. The marker plate strip construction according to claim 2 or 3, wherein the tear-off connecting members are formed from an elastically extensible material such that further separation of the adjacent plates after the full extension of the mechanical link.

9. Marker plates strips, accordingly to claim 2 or 3, wherein the tear-off are formed from a plastically extensible material such that further separation of the adjacent plates may take place after the full extension of the mechanical link.

* * * * *